United States Patent [19]

Schubert

[11] 4,123,950

[45] Nov. 7, 1978

[54] RETRO-FITTABLE TAPE TRIP MECHANISM

[75] Inventor: Keith E. Schubert, Rowayton, Conn.

[73] Assignee: Pitney-Bowes, Inc., Stamford, Conn.

[21] Appl. No.: 733,365

[22] Filed: Oct. 18, 1976

[51] Int. Cl.[2] ..... B65C 11/00; G05G 11/00

[52] U.S. Cl. ..... 74/625; 74/2; 74/479; 156/368; 156/442; 221/129; 226/134

[58] Field of Search ..... 74/2, 625, 89.20, 89.22, 74/96, 99 R, 479, 480 R; 221/129; 226/134, 135, 136; 156/368, 442

[56] References Cited

U.S. PATENT DOCUMENTS

| | | | |
|---|---|---|---|
| 2,621,543 | 12/1952 | Rossman | 74/625 |
| 3,198,086 | 8/1965 | Rager et al. | 74/99 X |
| 3,660,203 | 5/1972 | Beck et al. | 226/134 X |

FOREIGN PATENT DOCUMENTS

| | | | |
|---|---|---|---|
| 1,229,890 | 3/1960 | France | 74/479 |

*Primary Examiner*—Irwin C. Cohen

*Attorney, Agent, or Firm*—Peter Vrahotes; William D. Soltow, Jr.; Albert W. Scribner

[57] ABSTRACT

A tape trip mechanism is featured that is easily retro-fittable to postage tape dispensing machines in the field. The tape trip device is automatically operative in response to electrical control signals generated by a digital scale, a computer, or other electrical-type mail equipment. The tape trip mechanism is mounted within the postage tape dispensing machine by fastening the mechanism into existing holes in the inside frame. A flexible cable of the mechanism actuates the machine dispensing system by rotating a shaft supporting a manual trip lever. When the manual lever is exercised, the flexible cable is caused to collapse, and therefore, the cable does not interfere with the manual operation. Thus the automatic electrical control is independent from the manual control, allowing the user a greater flexibility in machine operation.

8 Claims, 3 Drawing Figures

RETRO-FITTABLE TAPE TRIP MECHANISM

The invention pertains to mail handling equipment, and more particularly to postage tape dispensing machines of improved design and versatility.

BACKGROUND OF THE INVENTION

Postage tape dispensing machines presently in use feature manual tape trip mechanisms. Attempts have been made to electrically control the tape dispensing, but these prior devices did not have the versatility of the present inventive mechanism.

One prior electrical control device pulled a detent, which was used to block the dispensing mechanism. This device was not retro-fittable, and could not be placed into the postage tape dispensing apparatus in the field.

Another prior mechanism mounted a solenoid to the outside of the postage dispensing apparatus, and was directly connected to the manual trip lever. This mechanism not only did away with the manual trip option, but was unsightly in its outside position.

The inventive apparatus seeks to correct the aforementioned drawbacks of these prior devices, by mounting the mechanism inside the machine using existing mounting holes in the inside frame. Thus, the invention seeks to provide an easily retro-fittably mounted tape trip control.

In addition, the control mechanism of the invention seeks to provide an automatic electrically operated trip which acts independently of the manual control lever, such that either operational method may be independently exercised by the machine operator.

SUMMARY OF THE INVENTION

The invention relates to a retro-fittable tape trip control for a postage tape dispensing machine. The tape trip device is automatically actuated and controlled in response to electrical signals generated by a digital scale, a computer, or other electrical-type mail equipment. The tape trip mechanism is mounted within a postage tape dispensing machine of the type manufactured by the present assignee of this invention, Pitney-Bowes, Inc., Stamford, Connecticut. Tape dispensing machines of the kind referred to herein, carry the model designations 5600; 5460; 4351 (4371); 4150; etc. The tape trip mechanism of the invention is fastened into existing holes in the machine frame, thus allowing the mechanism to be retro-fittable in the field.

A flexible cable of the inventive mechanism actuates the machine dispensing system by rotating a shaft supporting a manual trip lever. When the manual lever is exercised, the flexible cable is caused to collapse. The cable, therefore, does not interfere with the manual operation, as might be expected with a stiff-armed linkage. Thus, the automatic electrical control is independent from the manual control, allowing the user a greater flexibility in operating the tape dispensing machine.

The cable used to trip the dispensing mechanism is pulled by a solenoid, and is attached to the rotary shaft via a bell crank or pulley.

It is a primary object of this invention to provide a retro-fittable tape trip mechanism for a postage tape dispensing machine;

It is another object of the invention to provide an automatic, electrically actuated and controlled tape trip mechanism which operates independently, and does not interfere with the manual controls of a postage tape dispensing machine;

These and other objects of this invention will become more apparent and will be better understood with reference to the following detailed description, taken in conjunction with the accompanying drawings, in which.

DETAILED DESCRIPTION

Figure 1:
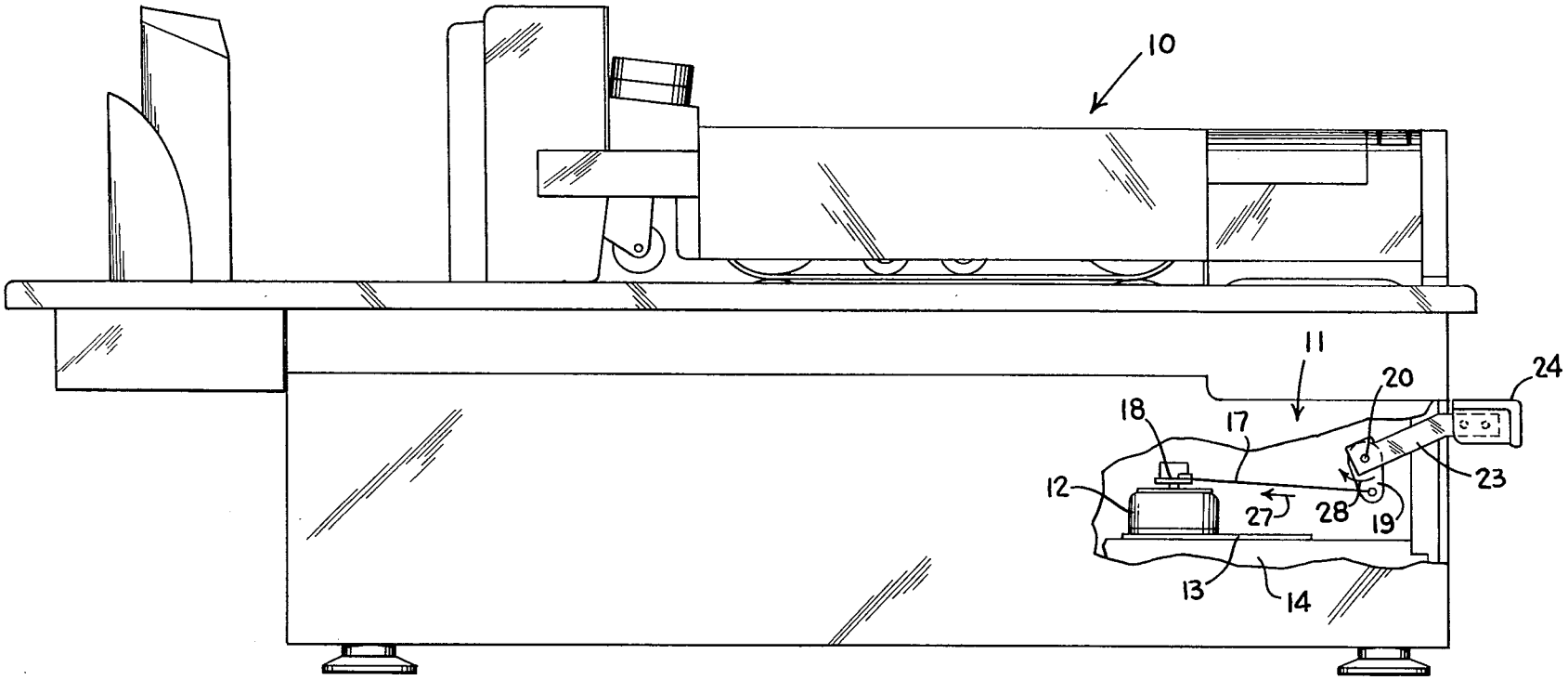
FIG. 1 is a front view of a postage tape dispensing machine of the type referred to, showing a cutaway view of the inventive tape trip mechanism mounted therein.

Referring to FIG. 1, a postage tape dispensing machine 10 is shown, which is manufactured by the assignee of the present invention, Pitney-Bowes, Inc., Stamford, Conn. The machine 10 may have one of the following model designations 5600; 5460; 4351 (4371); 4150 etc.

Figure 2:
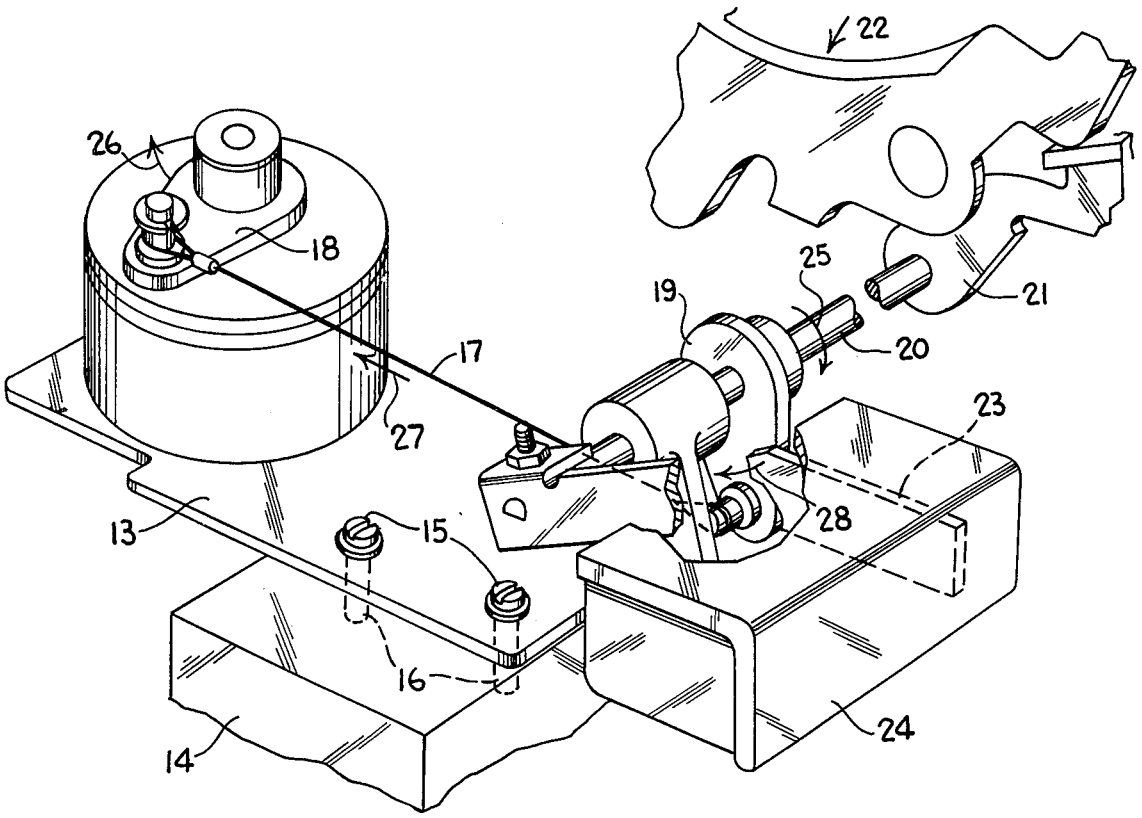
FIG. 2 is a perspective view of the inventive tape trip mechanism depicted in FIG. 1.

An automatic control mechanism 11 has been retrofitted to the machine 10 as shown in cutaway. A more detailed view of the automatic control mechanism 11 is depicted in FIG. 2. Discussion of the control mechanism 11 will be with reference to both FIGS. 1 and 2.

The control mechanism 11 comprises a rotary solenoid 12 affixed to a mounting plate 13. The mounting plate 13 is screw fastened to the frame 14 of the machine 10 via screws 15. The screws 15 are threaded into existing screw holes 16 in the frame 14 as illustrated in FIG. 2. This allows the control mechanism 11 to be retro-fittable to machine 10 in the field. The solenoid 12 is of the type (Model No. H2480-026) made by Ledex Inc., Dayton, Ohio.

A flexible cable 17 is attached to solenoid 12 via crank arm 18. The flexible cable attaches to another crank arm (bell crank) 19 on its other end. The crank arm 19 is fixed to a rotatable shaft 20, which actuates a tape dispensing trip lever 21 attached at its far end (FIG. 2). The tape dispensing appartus 22 is only partially shown for the sake of brevity, and operates as is commercially and commonly known.

The shaft 20 also carries a lever 23, which is used to manually trip the dispensing mechanism 22. A handle 24 is attached to the lever 23 to provide ease of operating or pressing down on the lever 23.

The arms 18 and 19, in conjunction with the flexible cable 17 form a four-bar linkage.

OPERATION OF THE INVENTION

In normal operation, the tape dispensing mechanism is actuated by manually pressing down on the handle 24. This will depress the lever 23, which will in turn rotate (arrow 25) shaft 20 as shown). The rotation of shaft 20 will trip the tape trip lever 21 to actuate dispensing mechanism 22.

In order to electrically and automatically actuate the postage tape dispensing mechanism 22, solenoid 12 is fed current in response to a signal from a digital scale, computer or other mailing equipment device. This in turn will cause arm 18 to pivot as shown by arrow 26. Arm 18 will pull upon cable 17 as depicted by arrow 27, which will cause arm 19 to pivot (arrow 28) and shaft 20 to rotate (arrow 25). Thus, the postage tape dispensing apparatus 22 will be actuated automatically.

Because cable 17 is flexible, when the lever 23 is manually depressed, the cable 17 will become slack. This of course, will not interfere with the automatic tape trip mechanism. In other words, both manual and automatic tape trip mechanisms act independently of each other, allowing the user of the postage tape dispensing machine 10 either operative option.

Figure 3:
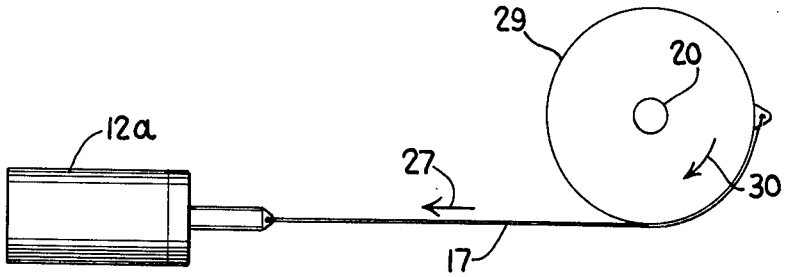
FIG. 3 is an alternate embodiment of the inventive mechanism illustrated in FIGS. 1 and 2.

Referring to FIG. 3, another embodiment of the invention is shown. Instead of a rotary solenoid 12, a straight pull solenoid 12 is mounted in its place to plate 13 (not shown). Cable 17 is once again caused to be pulled in direction 27 (arrow).

Cable 17 is operatively wrapped about, and attached to a pulley 29 as illustrated. The pulley 29 is fixed to shaft 20.

As the cable 17 is caused to be pulled, the pulley 29 is caused to be rotated (arrow 39), thus rotating shaft 20 as once before. Thus, the tape dispensing apparatus 22 will be actuated in response to the actuation of solenoid 12*a*.

Having thus described the present invention, what is desired to be protected by Letters Patent is presented by the appended claims.

What is claimed is:

1. A retro-fittable automatic electrically actuated tape trip mechanism for use with a postage tape dispensing apparatus, comprising:

a mechanical tape dispensing apparatus including a trip mechanism having a rotatable shaft for actuating said mechanical tape dispensing apparatus to dispense a quantity of postage tape when said shaft is rotated to a dispensing position;

a flexible cable operatively connected to said rotatable shaft for rotatively pulling said shaft from a rest position to said dispensing position;

a solenoid supported on said apparatus by mounting means and connected to said flexible cable for pulling said cable, and hence, rotating said rotatable shaft from said rest position to said dispensing position; and a manual actuation means connected to said rotatable shaft for manually tripping the tape dispensing apparatus without interfering with said solenoid, whereby said flexible cable is allowed to collapse when said manual actuation means is operated.

2. The retro-fittable automatic electrically actuated tape trip mechanism of claim 1, wherein said cable is operatively connected to said rotatable shaft via a bell crank.

3. The retro-fittable automatic electrically actuated tape trip mechanism of claim 1, wherein said cable is operatively connected to said rotatable shaft via a pulley.

4. The retro-fittable automatic electrically actuated tape trip mechanism of claim 1, wherein said solenoid is a rotary-type solenoid.

5. An automatic electrically actuated tape trip mechanism mounted within a postage tape dispensing machine, said dispensing machine containing a mechanically operative tape dispensing mechanism which has a rotatable shaft for actuating the tape dispensing mechanism, when said rotatable shaft is rotated from a rest position to a tape dispensing position, the automatic electrically actuated tape trip mechanism comprising:

a flexible cable operatively connected to said rotatable shaft at one end thereof;

a solenoid connected to said flexible cable on an opposite end thereof, said solenoid being electrically actuated to pull upon said cable, whereby the rotatable shaft is rotated from said rest position to said tape dispensing position; and a manual actuation means connected to said rotatable shaft for manually tripping the tape dispensing mechanism without interfering with said solenoid, whereby said flexible cable is allowed to collapse when said manual actuation means is operated

6. The automatic electrically actuated mechanism of claim 5, wherein said flexible cable is operatively connected to said rotatable shaft via a bell crank.

7. The automatic electrically actuated tape trip mechanism of claim 5, wherein said flexible cable is operatively connected to said rotatable shaft via a pulley.

8. The automatic electrically actuated tape trip mechanism of claim 5, wherein said solenoid is a rotary-type solenoid.

* * * * *